US005315729A

United States Patent [19]

Yang

[11] Patent Number: 5,315,729

[45] Date of Patent: May 31, 1994

[54] CUP WASHING MACHINE

[76] Inventor: Jack Yang, No. 7, 39th Str., Lane 399, Sec. 3, Chungshan Rd., Tan Tzu Hsiang, Taichung Hsien, Taiwan

[21] Appl. No.: 21,110

[22] Filed: Feb. 23, 1993

[51] Int. Cl.[5] ..... A47L 15/37; A46B 13/04

[52] U.S. Cl. ..... 15/75; 15/74; 15/88.3

[58] Field of Search ..... 15/71, 73–76, 15/39, 88.3

[56] References Cited

U.S. PATENT DOCUMENTS 2,631,313 3/1953 Webber ..... 15/75
4,791,693 12/1988 Kvaternik ..... 15/75
5,156,634 10/1992 Yang ..... 15/75

FOREIGN PATENT DOCUMENTS 599777 11/1959 Italy ..... 15/75

*Primary Examiner*—Edward L. Roberts
*Attorney, Agent, or Firm*—Bacon & Thomas

[57] ABSTRACT

A cup washing machine includes a first transmission shaft and a second transmission shaft respectively coupled to a motor drive by a set of gears, a third transmission shaft eccentrically coupled to the second transmission shaft, a first cylinder brush and a second cylinder brush respectively coupled to the first and third transmission shafts, a toothed lock block controlled by a lock control knob to lock the third transmission in a desired angular position for permitting the pitch between the first and second cylinder brushes to be adjustably set. A detergent dispensing can with a dispensing tube is mounted on the housing of the machine and controlled to disperse detergent to the cylinder brushes for cleaning cups.

3 Claims, 8 Drawing Sheets

CUP WASHING MACHINE

BACKGROUND OF THE INVENTION

The present invention relates to a cup washing machines, and more specifically the present invention relates to such a cup washing machine which can be conveniently adjusted to change the pitch between two cylinder brushes according to the size of the cup to be washed.

Various fully automatic dish washing machines have been disclosed for cleaning dishes, cups, and the like, and have appeared on the market. However, these fully automatic dish washing machines are expensive. There is also disclosed a vertical cup washing apparatus, as illustrated in FIG. 1, which is specifically designed for cleaning cups or like containers. This structure of cup washing apparatus is generally comprised of a plurality of cylinder brushes vertically mounted on the top of a base and driven by a belt drive. When in use, the cup washing apparatus should be placed in water within a washing-up sink. This structure of cup washing apparatus is heavy and inconvenient to deliver, and it needs a spacious washing-up sink to fit. Further, the problem of electric leakage may occur easily because it must be placed in water during its operation, and it is not sanitary to wash cups in standing water. FIG. 2 illustrates a horizontal cup washing apparatus which eliminates the disadvantages of the aforesaid vertical cup washing apparatus. This structure of horizontal cup washing apparatus is generally comprised of a motor, two transmission shafts coupled to the output shaft of the motor through a transmission gear, and two parallel cylinder brushes respectively coupled to the transmission shafts. When in use, the horizontal cup washing apparatus can be mounted on the casing of a water tap on a sink with the cylinder brushes suspended in the washing-up sink below the outlet pipe of the water tap. Different cylinder brushes may be alternatively used for cleaning cups of different sizes. However, this structure of horizontal cup washing apparatus is still not fully satisfactory in function. It is time consuming to replace different cylinder brushes according to different sizes of cups to be washed. Further, a detergent must be separately supplied while washing.

SUMMARY OF THE INVENTION

The present invention has been accomplished under the aforesaid circumstances. It is therefore an object of the present invention to provide a cup washing machine which can be conveniently adjusted to change the pitch between two cylinder brushes thereof according to the size of the cup to be washed. It is another object of the present invention to provide a cup washing machine which has means for holding and dispensing a detergent during its washing operation. It is still another object of the present invention to provide a cup washing machine which can be conveniently mounted on any of a variety of sinks at a desired location for convenient operation.

DETAILED DESCRIPTION OF THE PREFERRED EMBODIMENT

Figure 1:
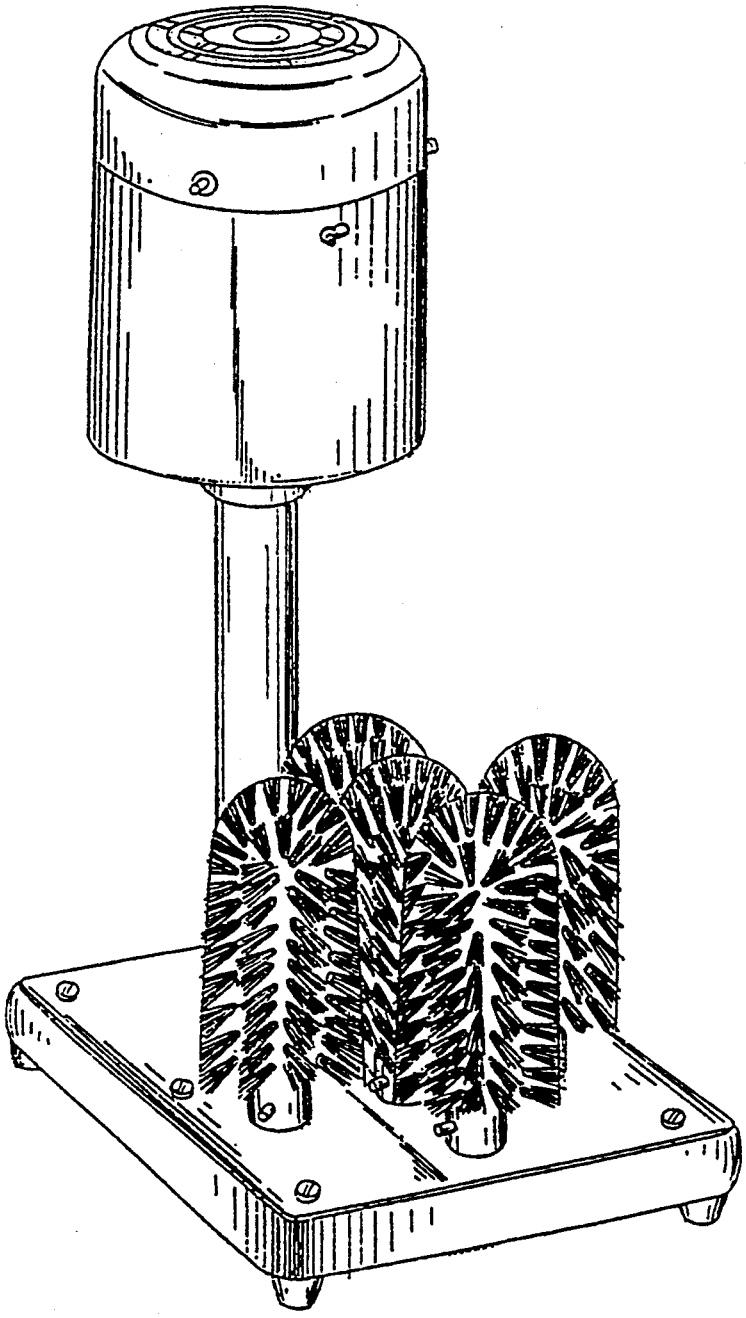
Fig. 1 PRIOR ART
FIG. 1 is an elevational view of a vertical cup washing apparatus according to the prior art.
Figure 2:
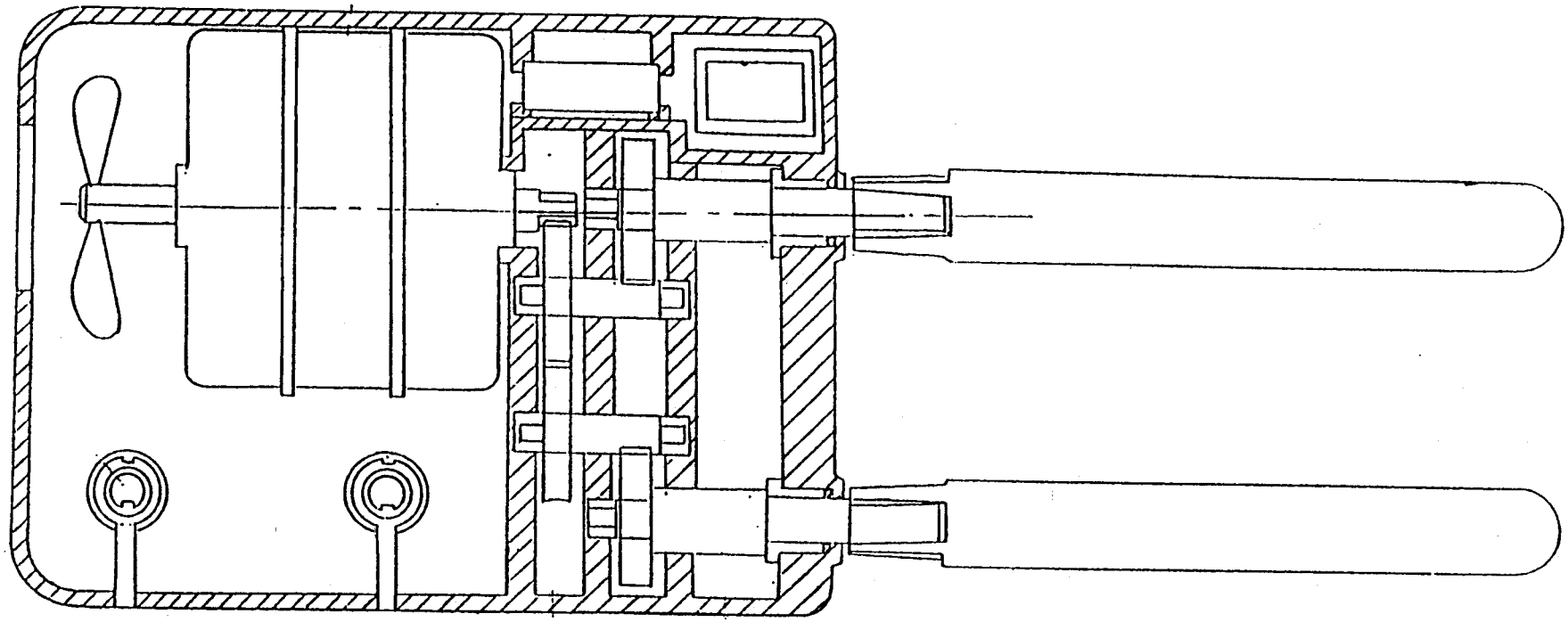
Fig 2 PRIOR ART
FIG. 2 is a plan section of a horizontal cup washing apparatus according to the prior art.
Figure 3:
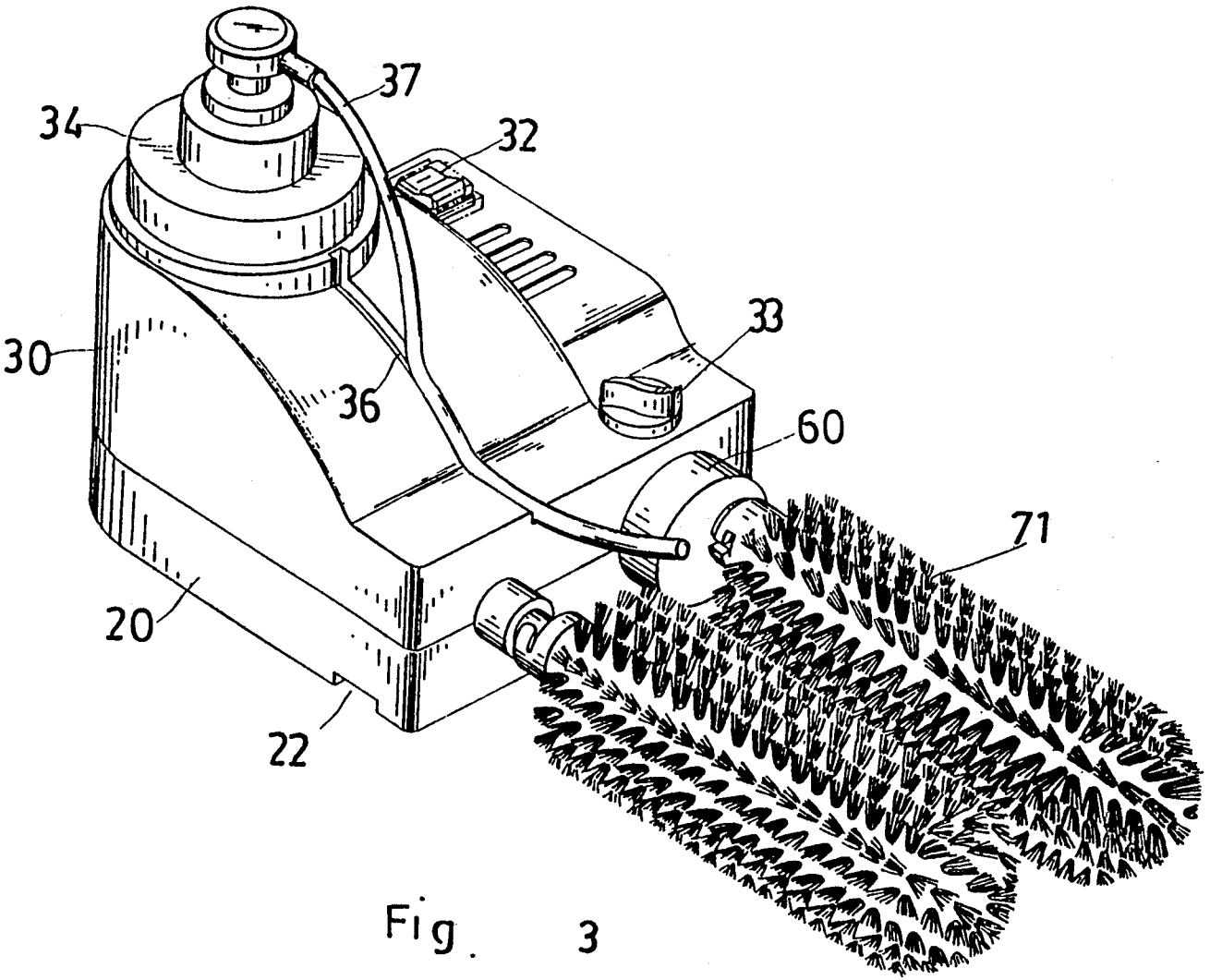
FIG. 3 is an elevational view of a cup washing machine embodying the present invention.
Figure 4:
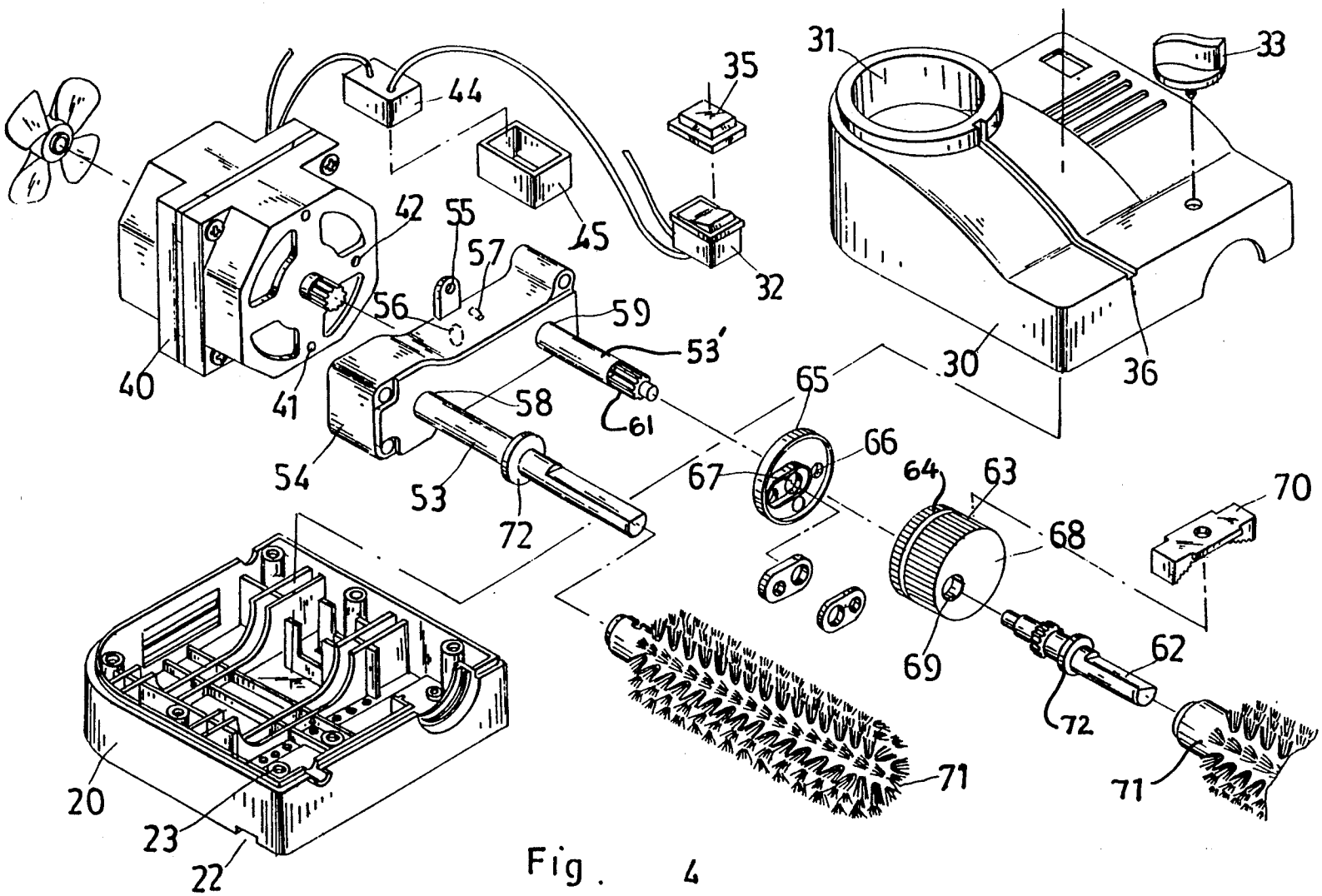
FIG. 4 is an exploded view of the cup washing machine of FIG. 3.
Figure 5:
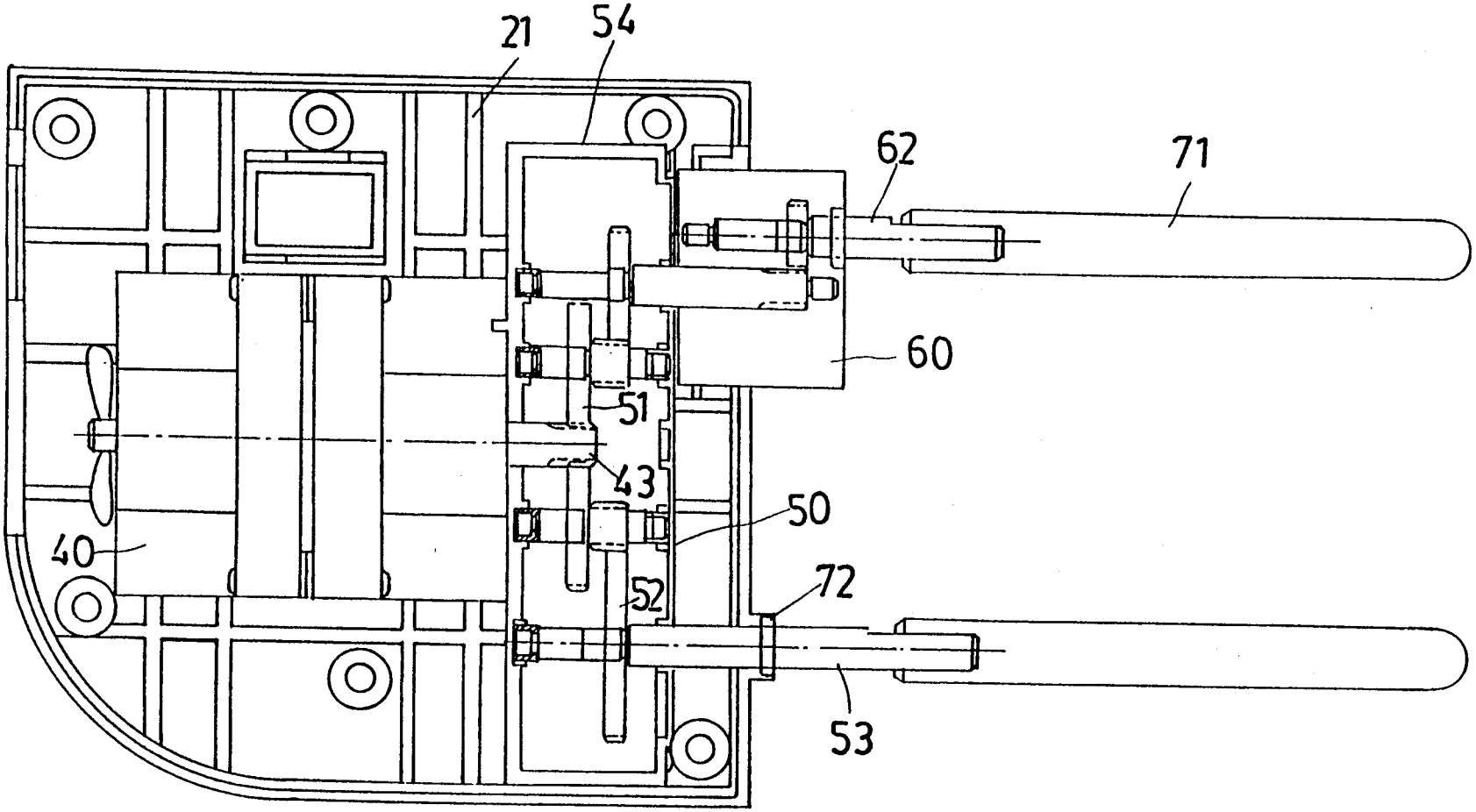
FIG. 5 is a plan section of the cup washing machine of FIG. 3.

Referring to FIGS. 3, 4 and 5, a cup washing machine in accordance with the present invention is generally comprised of a lower housing 20, an upper housing 30, a motor 40, a first transmission mechanism 50, a second transmission mechanism 60, and a pair of cylinder brushes 71. The upper housing 30 is fastened to the lower housing 20 and define a plurality of separate compartments 21 on the inside for receiving the motor 40, the first transmission mechanism 50, and the second transmission mechanism 60. The upper housing 30 includes a trough 31 at the top, which receives a detergent can 34, a longitudinal groove 36 extending from the trough 31 to the border of housing 30, which receives the dispensing tube 37 of the detergent can 34, a power switch 32 and a lock control knob 33 at suitable locations. The lower housing 20 comprises a transverse groove 22 at the bottom, and a plurality of screw holes 23 on the inside at suitable locations. The motor 40 includes two spaced screw holes 41 and a pin hole 42 on a front wall of the motor housing thereof for mounting the first transmission mechanism 50. The first transmission mechanism 50 comprises a driving gear 51 and two driven gears 52 received inside a casing 54, and a first transmission shaft 53 and a second transmission shaft 53' respectively connected to the drive gears 52. The casing 54 of the first transmission mechanism 50 comprises two mounting tabs 55 and a pin 57 corresponding to the screw holes 41 and the pin hole 42 on the motor 40 for mounting, a rear through hole 56 through which the output shaft 43 of the motor 40 is inserted and coupled to the driving gear 51, and two front through holes 58, 59 spaced on a front wall thereof through which the transmission shafts 53;53' are inserted and coupled to the driven gears 52 respectively. The second transmission mechanism 60 comprises a driving gear 61 received inside a peripherally toothed cylindrical casing 63 and coupled to the second transmission shaft 53' of the first transmission mechanism 50, a transmission shaft 62 inserted into an eccentric hole 69 on the front wall 68 of the peripherally toothed cylindrical casing 63, a driven gear 64 coupled to the transmission shaft 62 and meshed with the driving gear 61 inside the casing 63. The peripherally toothed cylindrical casing 63 is covered with a back cover 65. The back cover 65 has pin holes 66 for mounting on the casing 54 of the first transmission mechanism 50, and an axle hole 67 into which the second transmission shaft 53' is inserted. When installed, the peripherally toothed cylindrical casing 63 can be rotated on the back cover 65, which is fixed to the casing 54 of the first transmission mechanism 50, to adjust the pitch between the transmission shaft 62 of the second transmission mechanism 60 and the first transmission shaft 53 of the first transmission mechanism 50.

There is provided a toothed lock block 70 releasably disposable in meshed engagement with the peripherally toothed cylindrical casing 63 to hold it in position. The toothed lock block 70 is fastened to the lock control knob 33 at the bottom. Turning the lock control knob 33 in either direction causes the toothed lock block 70 to be meshed with or released from the peripherally toothed cylindrical casing 63. By releasing the toothed lock block 70 from the peripherally toothed cylindrical casing 63, the peripherally toothed cylindrical casing 63 can be turned on the back cover 65 to change the position of the transmission shaft 62 relative to the first transmission shaft 53 of the first transmission mechanism 50. Thus, the pitch between the two cylinder brushes 71, which are respectively coupled to the transmission shaft 62 of the second transmission mechanism 60 and the first transmission shaft 53 of the first transmission mechanism 50, is adjusted. The power switch 32 may be covered with a rubber cap 35 to protect against moisture and water. The capacitor 44 which is connected in series between the power switch 32 and the motor 40 is received inside a water-tight casing 45. Water seal rings 72 are respectively mounted on the first transmission shaft 53 of the first transmission mechanism 50 and the transmission shaft 62 of the second transmission mechanism 60 to seal the gaps.

Figure 6:
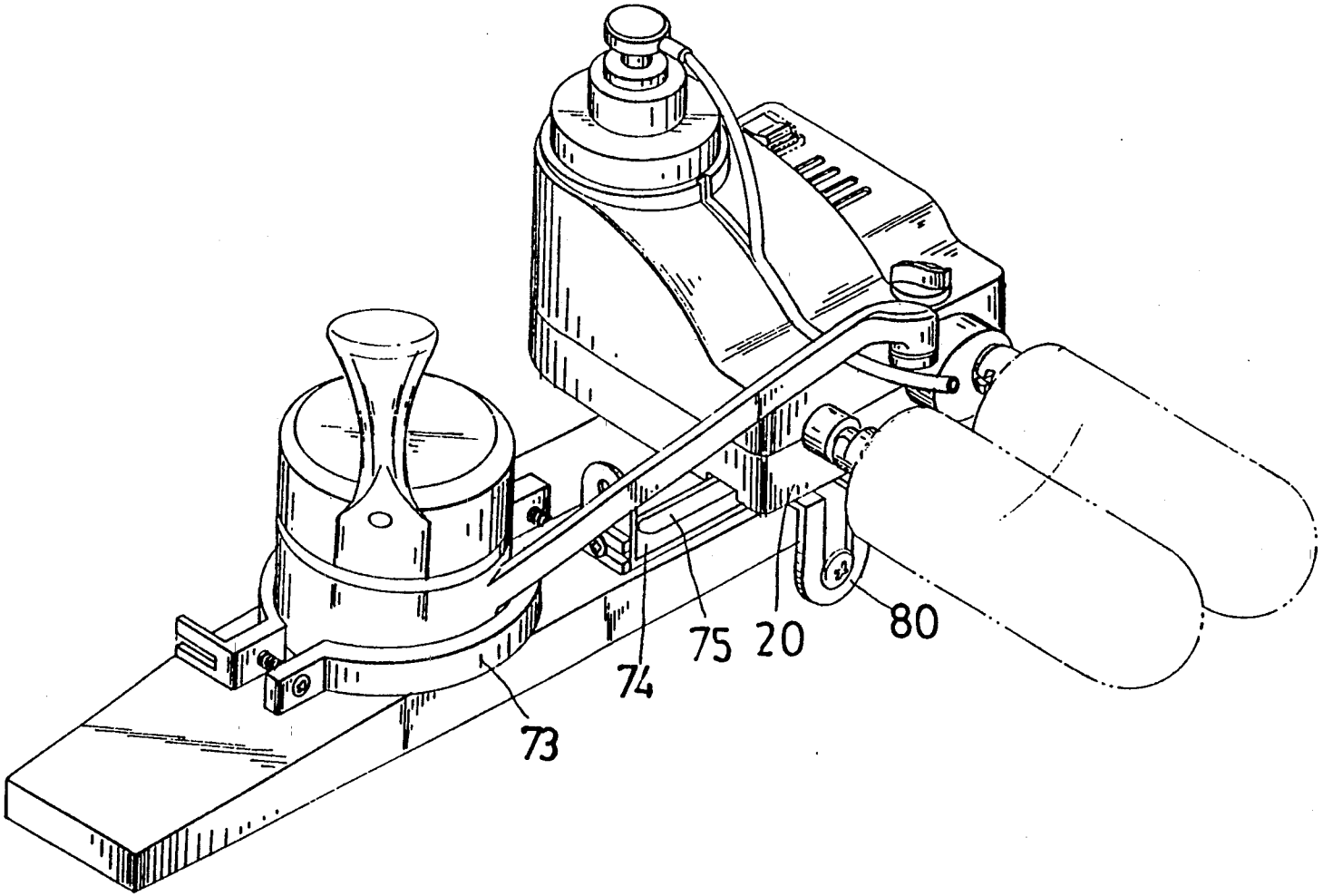
FIG. 6 is an example showing the cup washing machine of FIG. 3 mounted on the casing of a water tap.
Figure 7:
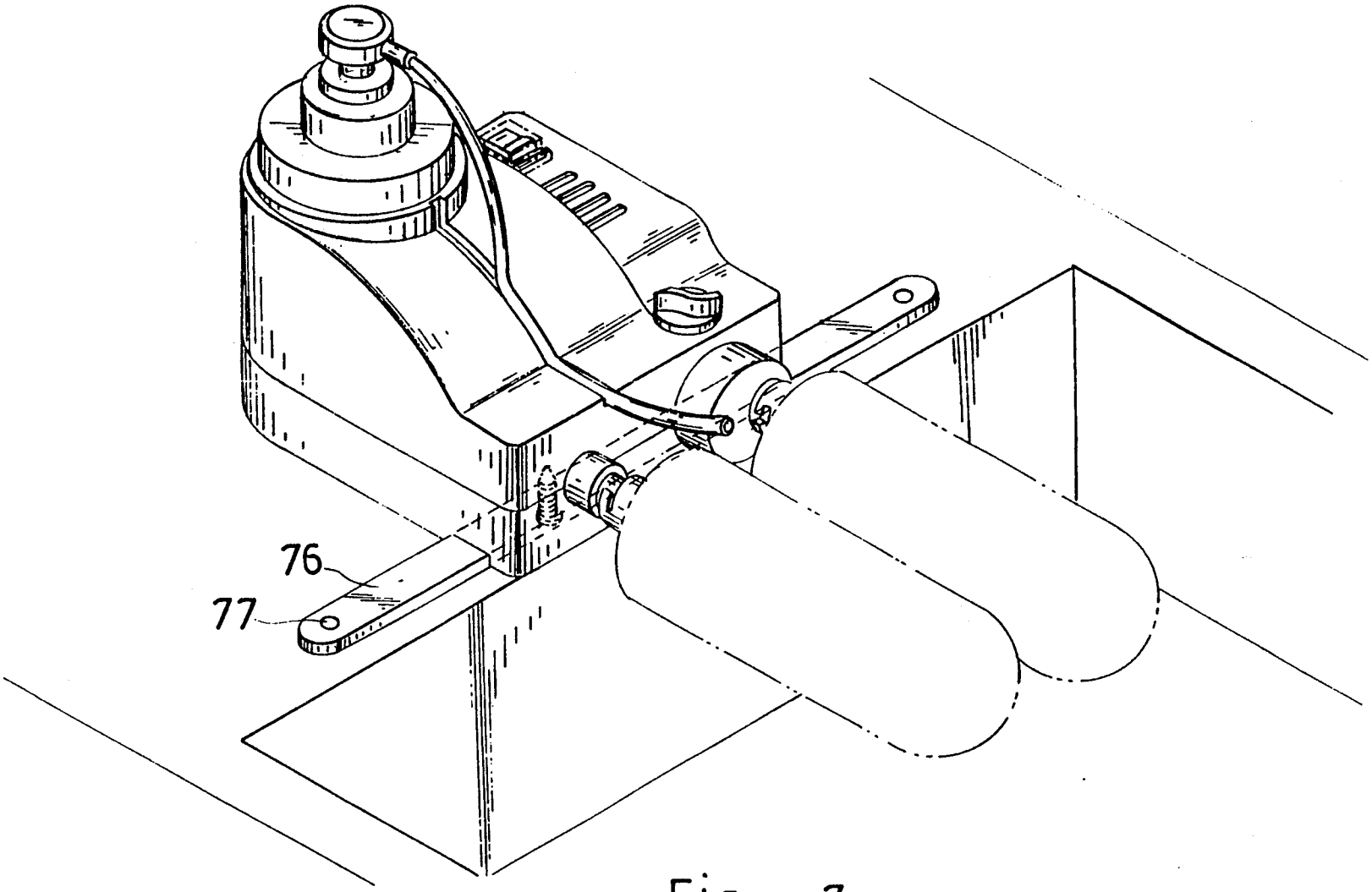
FIG. 7 is another installed example showing the cup washing machine of FIG. 3 mounted on a sink at the top by an elongated mounting frame.
Figure 8:
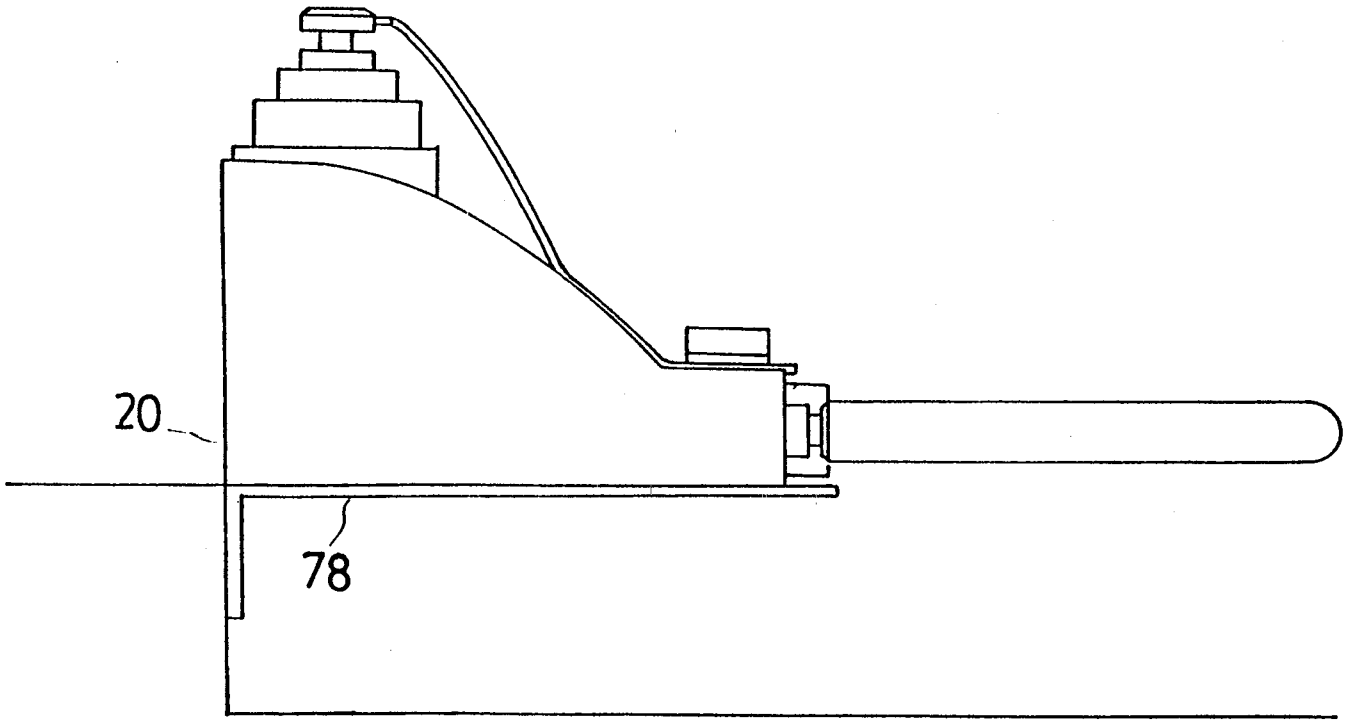
FIG. 8 is still another installed example showing the cup washing machine of FIG. 3 mounted on a sink by a bracket.

Referring to FIGS. 6, 7 and 8, the cup washing machine can be conveniently fastened to any of a variety of sinks by means of the transverse groove 22 and the screw holes 23 on the lower housing 20. As shown in FIG. 6, a clamp 73 is fastened to the neck of a water tap on a sink and connected to a slotted angle plate 74. The slotted angle plate 74 has an elongated slot 75 on a longer end thereof inserted in the transverse groove 22 on the lower housing 20 and fixed in place by screws (not shown). Two L-shaped mounting frames 80 are respectively fastened to the lower housing 20 of the cup washing machine by screws (not shown) to secure the cup washing machine to the peripheral wall of the sink. As shown in FIG. 7, the cup washing machine may be directly mounted on a sink at the top by an elongated mounting frame 76. The elongated mounting frame 76 is inserted through the transverse groove 22 on the lower housing 20, having spaced screw holes 77 for fastening to the screw holes 23 on the lower housing 20 and screw holes (not shown) on the sink. As shown in FIG. 8, the cup washing machine may be mounted on a sink above the basin 79 thereof by brackets 78.

While only the preferred embodiment of the present invention has been shown and described, it will be understood that various modifications and changes may be made thereto without departing from the spirit and scope of the invention.

I claim:

1. A cup washing machine comprising an upper housing covering a lower housing, a motor enclosed within the upper and lower housings, a first transmission mechanism coupled to said motor, a second transmission mechanism coupled to said first transmission mechanism, a first cylinder brush and a second cylinder brush respectively coupled to said first and second transmission mechanisms and positioned to wash cups;

said lower housing includes a transverse groove and a plurality of screw holes on a bottom surface thereof for mounting the machine;

said upper housing includes a trough at the top for receiving a detergent dispenser, a longitudinal groove extending from said trough to a border of the upper housing for receiving a dispensing tube from said detergent dispenser, a power switch for controlling the operation of said motor, and a lock control knob;

said motor includes a plurality of spaced screw holes, a motor housing, a pin hole on a front wall of the motor housing for mounting said first transmission mechanism, and an output shaft coupled to said first transmission mechanism;

said transmission mechanism includes a casing, a first driving gear and two first driven gears disposed inside the casing, and a first transmission shaft and a second transmission shaft inserted through a pair of respective holes on the casing and coupled to said driven gears, the driving gear of said first transmission mechanism being coupled to the output shaft of said motor, the casing of said transmission mechanism having a plurality of mounting tabs and a pin corresponding, respectively, to the plurality of spaced screw holes and the pin hole on said motor housing for mounting said casing on said motor housing;

said second transmission mechanism includes a peripherally toothed cylindrical casing and a second driving gear disposed inside the peripherally toothed cylindrical casing and coupled to said second transmission shaft of said first transmission mechanism, a third transmission shaft inserted through an eccentric hole on said peripherally toothed cylindrical casing, a second driven gear coupled to said third transmission shaft and meshed with said second driving gear, said peripherally toothed cylindrical casing being rotatably mounted on the casing of said first transmission mechanism and releasably locked by a toothed lock block, said toothed lock block being controlled by said lock control knob to engage with or disengage from said peripherally toothed cylindrical casing of said second transmission mechanism; and said first cylinder brush and said second cylinder brush are respectively coupled to said first transmission shaft and said third transmission shaft, wherein the pitch between said first cylinder brush and said second cylinder brush being adjustable by releasing said toothed lock block from said peripherally toothed cylindrical casing and rotating said peripherally toothed cylindrical casing on the casing of said first transmission mechanism.

2. The cup washing machine of claim 1 further including a slotted angle frame and a clamp for mounting the lower housing on a sink, the slotted angle frame being fastenable to the transverse groove and plurality of screw holes on the bottom surface of said lower housing.

3. The cup washing machine of claim 1 further including a bracket for mounting the lower housing on a sink and suspending the lower housing above a basin thereof.

* * * * *